US011536545B2

(12) United States Patent
Monetti et al.

(10) Patent No.: US 11,536,545 B2
(45) Date of Patent: Dec. 27, 2022

(54) PYROTECHNIC INSTALLATION CONSISTING OF AT LEAST ONE FIREWORK, AN ELECTRIC IGNITER, AND A DOCKING BASE, THE INSTALLATION COMPRISING A SYSTEM FOR REMOVABLY COUPLING THEM

(71) Applicant: Monetti S.R.L., Albinia (IT)

(72) Inventors: Luigi Leone Paolo Monetti, Albinia (IT); Andrea Lenzi, Grosseto (IT)

(73) Assignee: Monetti S.R.L., Albinia (IT)

( * ) Notice: Subject to any disclaimer, the term of this patent is extended or adjusted under 35 U.S.C. 154(b) by 13 days.

(21) Appl. No.: 16/980,537

(22) PCT Filed: Mar. 14, 2019

(86) PCT No.: PCT/IT2019/050055

§ 371 (c)(1),
(2) Date: Sep. 14, 2020

(87) PCT Pub. No.: WO2019/175912

PCT Pub. Date: Sep. 19, 2019

(65) Prior Publication Data

US 2021/0003372 A1 Jan. 7, 2021

(30) Foreign Application Priority Data

Mar. 14, 2018 (IT) ..... 102018000003551

(51) Int. Cl.
*F42B 4/20* (2006.01)
*F42B 4/26* (2006.01)
*H01R 12/71* (2011.01)

(52) U.S. Cl.
CPC ..... *F42B 4/20* (2013.01); *F42B 4/26* (2013.01); *H01R 12/714* (2013.01)

(58) Field of Classification Search
CPC ..... F42B 4/00; F42B 4/14; F42B 4/24; F42B 4/20; F42B 4/26; H01R 12/714
(Continued)

(56) References Cited

U.S. PATENT DOCUMENTS

2015/0159981 A1 6/2015 Forbes et al.
2021/0003372 A1* 1/2021 Monetti ..... F42B 4/26

FOREIGN PATENT DOCUMENTS

DE 69315420 3/1998
ES 2267354 A1 * 3/2007 ..... F42B 4/20
(Continued)

OTHER PUBLICATIONS

International Search Report and the Written Opinion dated Jun. 18, 2019 From the International Searching Authority Re. Application No. PCT/IT2019/050055. (14 Pages).
(Continued)

*Primary Examiner* — John Cooper

(57) ABSTRACT

The present invention concerns a coupling and power transmission system for an electric igniter, in particular for single-shot type fireworks (10), the system comprising a casing (11), in which the pyrotechnic components are housed, said casing having a first side that is open and a second side with a shaped connector (12), said shaped connector (12) comprising a channel (15) for connecting to said pyrotechnic components and adapted to removably receive an electric igniter (16), said electric igniter (16) being rigidly coupled to a printed circuit (18) on a PCB support (17), the printed circuit comprising two concentric tracks which are short-circuited via a connection track on a break-away tab (19) of the PCB support (17), whereby removal of the tab (19) eliminates the short-circuit, said shaped connector (12) being couplable, in a removable manner and with freedom of rotation with respect to an axis, to a docking base (13), said docking base (13) comprising the electronic components for transmission of an electrical signal to said electric igniter (16) and in particular three contacts (20), aligned with each other and dimensioned in relation to said printed circuit (18), ensuring connection between the tracks of said printed circuit (18) and the
(Continued)

contacts (20) independently of the angular position of said shaped connector (12) with respect to said docking base.

8 Claims, 7 Drawing Sheets

(58) Field of Classification Search
USPC ..... 102/342
See application file for complete search history.

(56) References Cited

FOREIGN PATENT DOCUMENTS

| | | | | |
|---|---|---|---|---|
| ES | 2268940 | | 3/2007 | |
| ES | 2268940 | A1 * | 3/2007 | ..... F41A 23/54 |
| FR | 2700073 | A1 * | 7/1994 | ..... H01R 13/6666 |
| GB | 1317254 | | 5/1973 | |
| WO | WO-2013053016 | A1 * | 4/2013 | ..... F41A 1/06 |
| WO | WO 2019/175912 | | 9/2019 | |

OTHER PUBLICATIONS

Rapport di Ricerca e Opinione Scritta [Search Report and Written Opinion] dated Nov. 14, 2018 From the Ministero Dello Sviluppo Economico, direzione Generale Sviluppo Produttivo e Competitivita, Ufficio Italiano Brevetti e Marchi Re. Application No. IT201800003551. (9 Pages).

* cited by examiner

PYROTECHNIC INSTALLATION CONSISTING OF AT LEAST ONE FIREWORK, AN ELECTRIC IGNITER, AND A DOCKING BASE, THE INSTALLATION COMPRISING A SYSTEM FOR REMOVABLY COUPLING THEM

RELATED APPLICATIONS

This application is a National Phase of PCT Patent Application No. PCT/IT2019/050055 having International filing date of Mar. 14, 2019, which claims the benefit of priority of Italian Patent Application No. 102018000003551 filed on Mar. 14, 2018. The contents of the above applications are all incorporated by reference as if fully set forth herein in their entirety.

FIELD AND BACKGROUND OF THE INVENTION

The present invention concerns a coupling and power transmission system for an electric igniter, in particular for single-shot type fireworks.

The invention relates to the field of electrical connections and in particular to those used in the fireworks industry.

In the fireworks industry two main categories of fires can be identified, the aerial fires (in particular those commonly referred to as "shells") and the ground fires (commonly divided into "candles", "fountains", "flare", "mines", "comets").

The present invention is aimed at ground fires, and in particular at those of the internationally called "single-shot" type, which include comets, blow-ups, fountains and theatrical effects.

It is known that the single-shot ground fires, hereinafter also referred to more simply with the wording of single-shot, consist of a tube open on one side and closed on the other to contain a launch charge and colorful, bursting effects or both. Single-shot fires need to be triggered by an intense heat source, usually an electric igniter, which must come into contact with the launch charge, which, once triggered, projects the effects out of the tube instantly.

To use single-shots it is necessary to position them steadily on a support so that they remain in the same position during ignition. The support, in turn, must be a stable and/or adjustable platform.

The heat source to trigger single-shots is usually an igniter that is activated by an electrical impulse. The igniter is made up of an electrical resistance, which passes through a solid pyrotechnic head formed by a pyrotechnic mixture. The resistance is connected to two electric rheophores. By making electric current flow through the rheophores, the resistance is overheated, and that in turn triggers the pyrotechnic head, which creates a contained deflagration, capable of propagating heat and sparks. The heat and sparks are in turn able to trigger the single-shot.

In some cases, the heat source to activate the single-shot can be obtained through a direct electrical resistance, without a pyrotechnic mixture, which overheats due to the flow of a current flowing through it.

Finally, the heat source to trigger the single-shot must be electrically connected to a power source and to a more complex firing system, capable of managing a limited presence of stray currents in the field.

Current systems for using single-shots involve many phases: production, insertion of the trigger, installation and final use. Each operation or manipulation of the single-shot involves, in itself, a risk to the safety of the operator. Moreover, these operations also involve a lot of work time, since they must be done manually and very carefully.

It is therefore easy to understand that limiting the number of operations means making a significant contribution to the safety of this sector.

According to the prior art, it has been proposed to produce the single-shot in a tube of various diameters, closed on one side and open on the other. The tube can be entirely in plastic or partly in cardboard (the cylinder) and partly in plastic (the closing base). In both cases, near the closed side, the tube has a hole communicating with the inside, which is placed laterally, on the base or on the bottom. The hole is used to insert the trigger, consisting of an electric igniter. The electric igniter consists of a pyrotechnic head, normally covered by a cylindrical plastic protection, which can be placed in the hole of the tube. Once inserted in the hole, the head must be fixed to prevent it from coming out later. The igniter has two rheophores, connected to the head, which can be of different lengths. The rheophores have the function of letting the current that activates the trigger flow, therefore they need to be connected to any power source, capable of generating an electrical impulse. Usually, it is a dedicated shooting system, which is pre-programmed for its automatic operation.

For the installation and use of the single-shot, the tube containing the article must rest, on its closed side, on a generic support, on which it must then be firmly fixed. The support ensures that the firework remains oriented upwards or in a specific ballistic direction and must remain in the same position during its operation and thus maintain a launching path that is not dangerous for things and people. The supports on which the single-shots are installed are multiple and/or modular, able to contain, in the same launching station, numerous fireworks positioned one next to the other.

This methodology is the most widespread but, despite being very reliable, it requires many steps and a lot of manpower to be implemented. In fact, according to this methodology, in a first phase, it is necessary to insert the electric igniter in the hole of the firework, in a second phase it is necessary to solidly fix in the correct position the already triggered single-shot to the support, and finally in a third phase it is needed to lay the rheophores (the cables) and connect them to the power source, usually near the support. These operations must be carried out manually and each involves multiple risks. The insertion of the igniter in the hole, for example, exposes to danger from the accidental ignitions of the igniter itself (and therefore also of the article to which it is about to be connected), due to the friction or rubbing of the pyrotechnic head. The movement of the leads, often free during insertion, endangers the operator, due to the potential electrostatic discharges that can occur if the ends of the conductors come into contact with bodies with electrical potential difference. Moreover, even in this case the igniter can be activated when it is not foreseen.

Even repeated manipulation of the firework in the various manual steps involves risks such as falling, breaking or damage, with possible spillage of the contents. The basic rule of the pyrotechnic profession is to manipulate a firework as little as possible, until it is safely ignited, at which time it loses its pyrotechnic properties and therefore becomes harmless. It must be considered that all these operations are carried out in most cases at ground level and therefore in uncomfortable and not very ergonomic positions for the operators.

Furthermore, this system implies an additional danger during the execution of a fireworks show: in the event of an explosion due to a technical problem (defective device and/or failure of the supports), this propagates its fragments in the surrounding space with the effect of projecting the single-shots installed in its proximity in any directions. In this situation, it becomes possible that a certain number of single-shots in a position that is no longer as safe as the initial one and with a launch trajectory different from the one originally set, therefore potentially dangerous, but still triggered, with the electric igniter connected to the power source by the rheophores. Given that most of these single-shots are electrically activated by pre-programmed automatic systems according to pre-set times, the resulting risk consists of a potential firing sequence of fireworks in multiple directions, not predictable, with obvious potential danger to things and people.

According to WO 2012/072832 A1, a single-shot is produced in a plastic tube of various diameters closed on one side and open on the other. The closed side of the tube is shaped so that it can be inserted in specific supports, using a sliding movement on a track or a joint. The hole for inserting the igniter is positioned near the base, with side or bottom access. The insertion in the hole of the igniter with rheophores and the connection of the latter to an energy source is an operation identical to that described above.

This methodology, with respect to that described in the previous paragraphs, facilitates the fixing of the device on its specific supports, which must support it during use. The shaped base of the tube, compatible with the specific support, makes this fixing easier. Despite this, all the dangers listed with reference to the previous technical solutions remain, in particular those related to the insertion of the electric igniter in the hole for the triggering of the launch charge, to the manipulation of the firework, to the rheophores and to the explosion situation with consequent scattering of the neighboring fireworks.

Furthermore, it can happen that a firework is connected to a faulty electric igniter and this is detected only during circuit testing, after having carried out the installation. In this case, it is necessary to intervene directly on the firework to replace the trigger. In the case of a rail support with a hole in the bottom of the tube, removing the trigger of a single firework involves having to remove all the other fireworks on the same row, until the defective one is reached, remove it, replace the igniter, then proceed to re-enter all the fireworks in the track. This additional delicate operation with fireworks already triggered adds risks and inconveniences.

In the case of a hole in the bottom of the tube, the operation of laying the rheophores is very complicated. As previously mentioned, the supports are multiple and contain numerous single-shots, this situation helping to create multiple beams in pairs of rheophores, to be conveyed towards the power source, a very delicate and intricate operation.

Moreover, always in the case of a hole in the bottom of the tube, the accidental loss or disconnection of the igniter, during the various manipulations, can cause the active content of the article to be returned to the ground.

According to US 20160195372 A1, a single-shot is produced in a plastic or cardboard tube of various diameters, open on one side and closed on the other by a pre-installed plastic cap. On the upper part of the cap there is a thin electrical resistance to be overheated (which differs from the electric igniter due to the lack of pyrotechnic material). On the lower part of the cap there are a bayonet coupling and two electrical contacts, connected to the electric resistance placed on the upper part. When overheated by electric current, the electric resistance transmits heat to trigger the firework launch charge. For this reason, its surface is arranged so as to optimize its contact with the launch charge. The bayonet coupling is used to fix the pre-installed tube and cap on a specific support, a platform that consists of a fixing base with four housings aligned each with a locking mechanism. The base has two other electrical spring contacts, intended to coincide with the electrical contacts on the lower part of the cap. Once the cap is properly coupled with the base, the respective pairs of contacts are aligned mating to create electrical continuity. Finally, the circuit interfaces to the power source via a RJ45 CAT5 type connector.

This system of use of single-shots presents several critical issues, from an electrical and mechanical point of view.

The triggering system making use of an electric resistance, which works on the transmission of heat alone (incandescent bulb effect) is not as effective as that of an electric igniter, which on the contrary generates a real deflagration, with propagation of heat and sparks. This feature obliges the manufacture of the single-shot launch charge to a finer grain size, to offer greater contact surface and therefore greater probability of ignition. This contributes to the increase in the final cost of the firework and above all to the increase of its danger. Moreover, the system increases the probability of failure of the trigger, with the consequence of having to recover, during disassembly, still active fireworks.

The electric resistance, in order to reach sufficient heat and guarantee the ignition of the launch charge, necessarily implies the use of more important currents, coming from the electric source or from the firing system, compared to an electric igniter which operates at low amperage. The on the field administration of more important currents constitutes a greater danger during the operation of connecting the single-shots to the electric circuits, both in the assembly phase and in the test phase. It is always advisable to maintain low amperages in the field, to prevent inadvertent ignitions or cause dangerous situations. Furthermore, greater current means greater energy consumption than electronic firing systems, which therefore require additional batteries.

Furthermore, the electric resistance, as a method of ignition in direct contact with the launch charge, is subject to frictions and rubbing which can occur from the moment of manufacture of the firework until its use. These rubbings can damage the very thin filament, breaking it, or an interruption can happen due to manufacturing defects. If this problem occurs with the system described herein, the operator is not in a position to replace the trigger and avoid failure to ignite of the firework. The configuration of the cap pre-installed and sealed with the tube in the factory does not allow its replacement, except by misusing the firework, which needs to be disassembled; however, this operation must be carried out in suitable places, such as factories, and by expert personnel. Operators who carry out the preparation of fireworks are very rarely qualified to manufacture them, since they are two different skills. This makes the replacement of the trigger with resistance on the plug impossible to perform in firing places, forcing the operator to replace the entire firework and dispose of the defective but still intact one.

From a mechanical analysis, the bayonet coupling requires the coupling operation between the cap and the base to be performed through a very constrained movement. First of all, it is necessary to find the correct initial position on a 360° rotation, with movement on a horizontal axis, after which it is necessary to press vertically from that position to compress the spring contacts located on the base. Finally, maintaining the vertical pressure, it is necessary to rotate the cap again, horizontally clockwise by a quarter of a turn, until the locking mechanism clicks. The grooves and the angles, present on the objects to guarantee the hooking, make this operation not fluid. The coupling operation is particularly complex, even more so if one considers the effect of the electrostatic discharges (ESD) that can be generated during rotation near the free contacts.

The fixing base has four aligned slots, the spring contacts of each of the slots are soldered onto an electronic board. This forces the positioning of the single-shots at a close distance between each other and avoid the operator must take the final decision regarding this distance, which may involve risks depending on which fireworks are being used. In fact, some single-shots create a stronger explosion than others and require a greater positioning distance from each other, at the discretion of the professional operator. Furthermore, when positioning single-shots, it may be necessary to tilt them at different angles. The four-position fixed base is limiting, since it forces an inclination in a group of four and does not allow a free and independent orientation of the single fireworks.

The four-position fixing base foresees the conveying of the circuits by means of an electronic card and an RJ45 type connector. As a result, although there are multiple firing systems currently on the market, this type of electrical interface implies that the system is compatible with only one specific firing system, eliminating the possibility of using the entire system in a standardized and open way.

Finally, the cap with the resistance is not reusable and, being pre-installed with the tube, forces it to be disposed of as special waste, since it is not possible to separate the plastic from the metal, in the case of the cap only, and from the cardboard, in the case of the complete firework.

Moreover, according to the prior art, there are supports and clutches, or bases and plugs, which are used to couple electric detonators to an electrical circuit. These systems, designed for the activation of energetic material, allow the coupling with the triggers through a configuration that could be assimilated to a system applicable also for the preparation of single-shots. In particular, U.S. Pat. No. 8,100,043 describes a system that presents a method of insertion and fixing between the electrical circuit and the receiver (the base on which the trigger has to be inserted), which is obligatory and unambiguous to ensure that the contacts are aligned in a determined position, because otherwise they would not correspond and would not guarantee the continuity of the electrical circuit.

Likewise, an insertion system limited to a maximum of two obligatory positions between the coupling and the support is disclosed. Also this limitation of movement is denoted by the specific shapes of the interlocking profiles and the locking systems.

The correct functioning of this system is therefore closely related to the alignment of the components.

Always according to the prior art, more generic coupling systems of pyrotechnic detonators with plastic supports also exist. US 20030183110 describes a specific method for coupling two pyrotechnic charges, one primary and one secondary (the booster) with the function of activating an important and increasing pyrotechnic reaction, typical of applications in the field of Automotive.

The system makes no reference to the electric circuit or to electric current transmission methods to activate the described device. The device has exposed contacts, which however must be locked in a certain position in order to correspond to specific connectors.

In this context it is inserted the solution according to the present invention, that aims to provide a coupling and power transmission system for an electric igniter, in particular for single-shot type fireworks, with the following objectives:

- making the work of setting up single-shots faster, easier and safer, with a consequent reduction in risks and costs;
- reducing the number of manual operations to be performed during the assembly and use of single-shots, with a consequent increase in safety for operators;
- offering a quick coupling system between firework, trigger and electrical circuit, such as to make the coupling more immediate and easier, waiving the operator from further movements;
- guaranteeing an effective and reliable single-shot ignition system, by means of an electric igniter specifically designed to be independent of fireworks, or to be inserted and removed as required, even directly before use, in the event of a malfunction, and for its use without the rheophores;
- maintaining a safe working setting, with the electric igniter short-circuited, protected from potential electrostatic discharge (ESD), until the final positioning of the single-shot in the dedicated supports;
- reducing the risk of explosion and propagation of fragments in the event of technical malfunctions deriving from defective fireworks;
- avoiding having to perform multiple operations to replace defective single-shots, detected during the test phase;
- offering a system that allows, in case of detection of defects, to replace the trigger without having to manipulate the firework in unsuitable places;
- creating a system of free and independent supports, to be a standard interface usable and reusable with the various existing shooting systems;
- maintaining a system that allows the disposal of homogeneous materials (for example: only plastic), limiting the creation of mixed special waste (example: paper and plastic to be separated).

These and other results are obtained according to the present invention by proposing a coupling and power transmission system for an electric igniter, in particular for single-shot type fireworks, which comprises a plastic tube, which constitutes the casing of the article, having a shaped lower end and a base, inside which the mechanical and electronic components are housed, in which the continuity of the circuit remains independent of the angle of the tube on the horizontal axis and in which the contacts present on the base are connected to connectors (terminals) generic for electric cables, placed outside the docking base, making the system connectable and interfaceable with any power source; the coupling and transmission system is made entirely of plastic so, once the igniter is removed, it can be disposed of without creating mixed special waste.

SUMMARY OF THE INVENTION

The object of the present invention is therefore to provide a coupling and power transmission system for an electric igniter, in particular for single-shot type fireworks, which allows to overcome the limits of the systems according to the prior art and to obtain the technical results previously described.

A further object of the invention is that said coupling and power transmission system can be realized with substantially contained costs, both as regards production costs and with regard to management costs.

Not least object of the invention is to propose a coupling and power transmission system for an electric igniter, in particular for single-shot type fireworks which is simple, safe and reliable.

It is therefore a specific object of the present invention a pyrotechnic installation comprising at least one firework, in particular of the single-shot type, an electric igniter and a docking base, a removable coupling system between said firework and said electric igniter, a removable coupling system between said firework and said docking base and a removable coupling and current transmission system between said docking base and said electric igniter, said firework comprising a casing, in which the pyrotechnic components are housed, said casing having a first side that is open and a second side with a shaped connector, said shaped connector comprising a channel for connection to said pyrotechnic components and for housing of said electric igniter, said electric igniter comprising a pyrotechnic head covered by a protective cap equipped with a sealing area and equipped with contacts, said sealing area constituting a hydraulic seal on the walls of said channel, said contacts being rigidly coupled to a printed circuit of a PCB support, said printed circuit comprising two concentric tracks, each connected with a contact of said pyrotechnic head of said electric igniter and said printed circuit being short-circuited, through a connection track between said two concentric tracks, said connection track being made on a removable portion of said printed circuit of a PCB support, to remove short-circuiting by removing said removable portion, said shaped connector being couplable, in a removable manner and with freedom of rotation with respect to an axis, to said docking base, said docking base comprising the electronic components for transmission of an electrical signal to said electric igniter and in particular three contacts, aligned with each other and dimensioned in relation to said printed circuit, ensuring connection between the tracks of said printed circuit and the contacts independently of the angular position of said shaped connector with respect to said docking base.

Preferably, according to the invention, said removable portion of said printed circuit PCB support is connected to the rest of the PCB support through a break line.

Furthermore, according to the present invention, said printed circuit PCB support is stop coupled on said shaped connector.

Always according to the invention, said removable coupling system between said firework and said docking base comprises a shaped connector of said firework and a corresponding housing of said docking base, said housing being open upwards and provided of elastic guillotine locking mechanism, with elastic fins.

BRIEF DESCRIPTION OF THE SEVERAL VIEWS OF THE DRAWINGS

The present invention will now be described, for illustrative but not limitative purposes, according to a preferred embodiment thereof, with particular reference to the figures of the enclosed drawings, in which:

FIG. 2 shows a bottom perspective view of the lower part of the casing and of the electric igniter of FIG. 1, FIGS. 3A and 3B respectively show a top view and a side view of the docking base of FIG. 1, FIGS. 4A and 4B respectively show a bottom view and a side view of the electric igniter of FIG. 1, while

DESCRIPTION OF SPECIFIC EMBODIMENTS OF THE INVENTION

Figure 1:
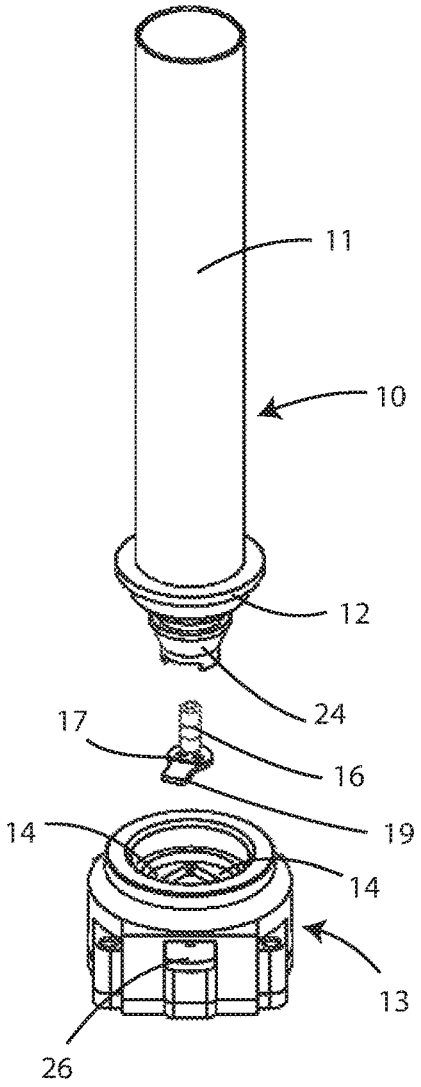
FIG. 1 shows a top perspective view of a casing of a single-shot firework, an electric igniter and a docking base implementing a coupling and power transmission system for an electric igniter according to the present invention.
Figure 2:
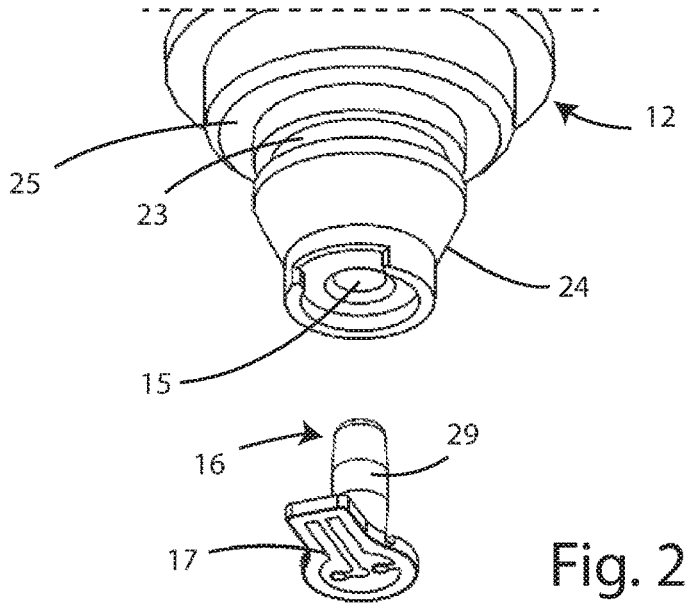
Figure 3A:
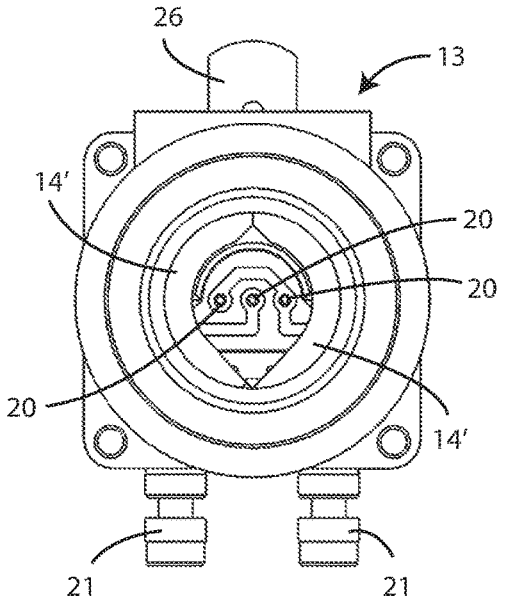
Figure 3B:
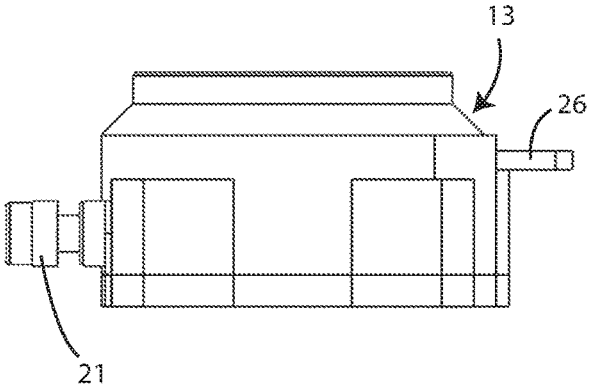
Figure 4A:
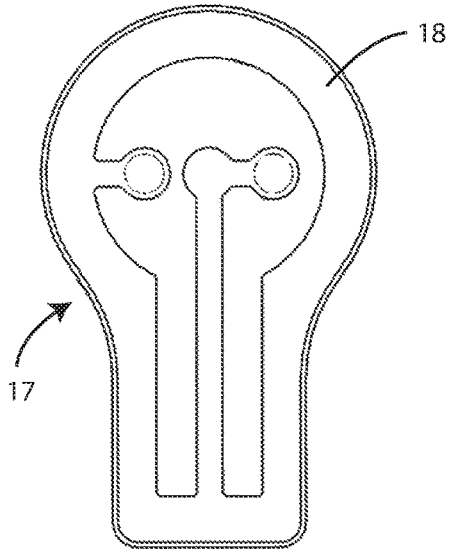
FIG. 4C shows a side view of an electric igniter according to a different embodiment.
Figure 4B:
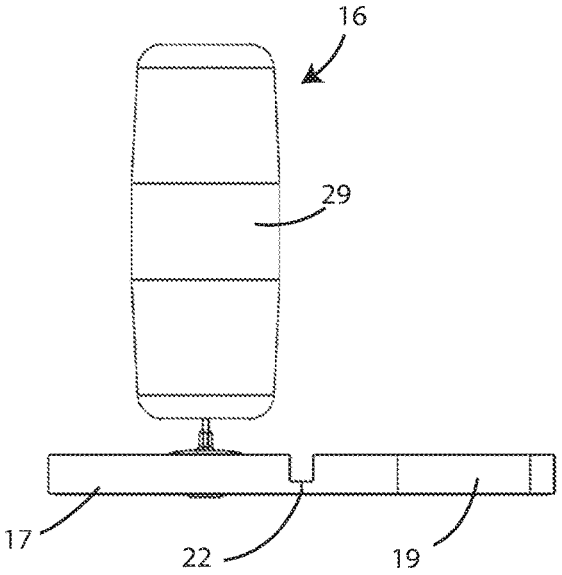
Figure 4C:
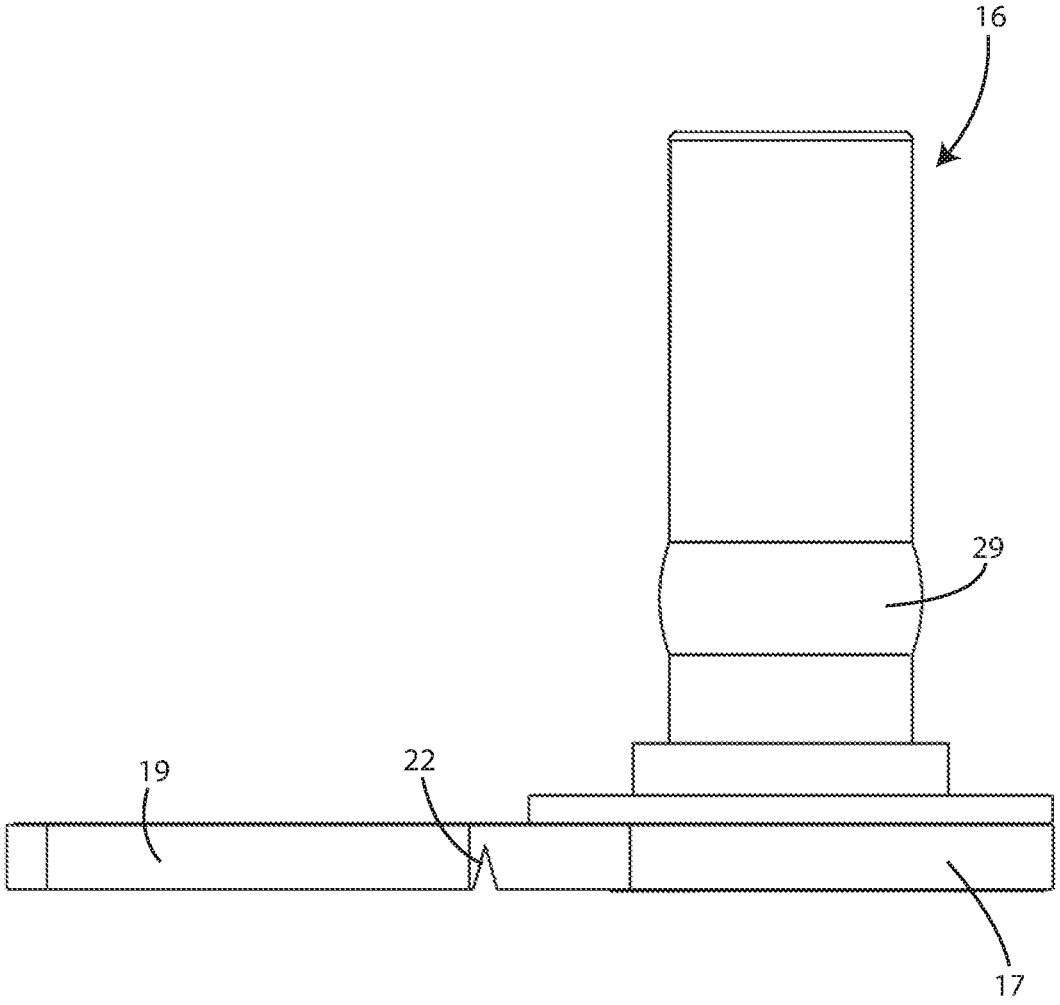

With reference to the figures, a single-shot firework is shown, indicated with the reference number 10, comprising a casing 11 for containing the fireshot, said casing consisting of a plastic tube. The casing 11 is totally open on one side and is coupled to a shaped plastic connector 12, on the other side, which can be inserted in a housing of a docking base 13 and which can be anchored inside said housing by means of an elastic guillotine locking mechanism, with elastic fins 14. As will be illustrated in detail below, by inserting the shaped connector 12 of the single-shot 10, from above, in the housing of the docking base 13, the fins 14 of the elastic guillotine first open and then close, independently, firmly blocking the single-shot 10 to the docking base 13. The shaped connector 12 of the single-shot 10 provides, in its initial part, an axial channel 15, which leads directly into the inner part of the casing 11, where the pyrotechnic components of the fireshot is housed. In this axial channel 15 a single electric igniter 16 is inserted, devoid of rheophores, welded onto a closed printed circuit 18 PCB support 17.

The inner part of the casing 11, where the pyrotechnic components of the fireshot is housed, has a net that separates it from the channel 15, creating meshes that allow the transmission of the flame coming from the electric igniter 16, provided with a similar net on the upper end of its hood, and at the same time prevent the accidental passing of the launch charge placed in the base of the casing 11. To obtain this effect, the meshes of the net are smaller in size with respect to that of the granules of the powder of the launch charge (which have a grain size of the order of 1 mm). With the insertion of the electric igniter 16 inside the channel 15 two different perforated layers are created, a few millimeters apart, which prevent the loss of the granules of the launch charge and at the same time allow the transmission of the flame.

Furthermore, the electric igniter 16 has a substantially cylindrical body, covered by a protective cap equipped with a sealing area 29, made by shaping the lateral surface of said protective cap, so as to come into contact with the walls of said axial channel 15, in correspondence of a seat made on the walls of said channel to couple with said shaping, to establish a hydraulic seal such as to prevent the entry of moisture into the inner part of the casing 11, where the pyrotechnic components of the fireshot are housed, without having to use sealants that would compromise the possibility of removing the electric igniter 16 when needed.

The electric igniter, unlike those of the prior art, provided with rheophores, is welded on a printed circuit 18. In the following, this electric igniter 16 can also be defined as "rigid igniter" (Secured Igniter), and indicated with the same numerical reference. The printed circuit 18 is intentionally short-circuited, to guarantee protection in the event of ESD (Electro-Static Discharge) or unintentional ignition which, otherwise, could inadvertently trigger the igniter and, consequently, the single-shot 10 itself.

The contacts of the pyrotechnic head of the electric igniter 16 appear on two concentric tracks aligned axially to the casing 11.

Figure 5:
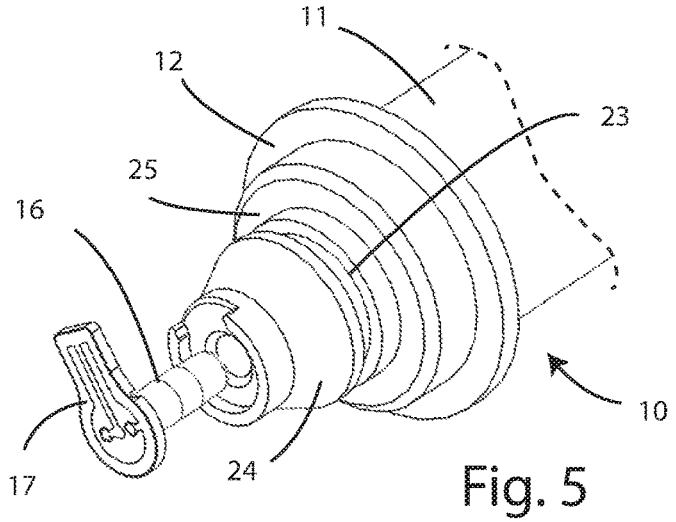
FIG. 5 shows a bottom perspective view of the lower part of the casing and of the electric igniter of FIG. 1, in a first coupling step.
Figure 6:
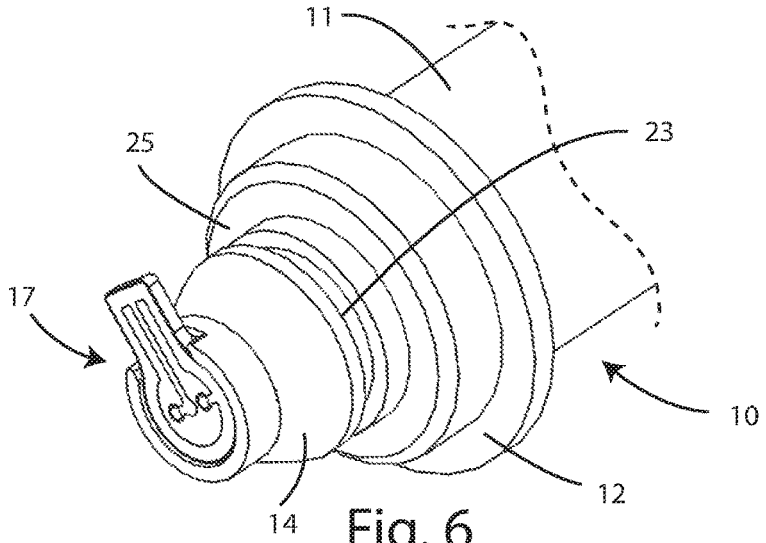
FIG. 6 shows a bottom perspective view of the lower part of the casing and of the electric igniter of FIG. 1, in a second coupling step.
Figure 7:
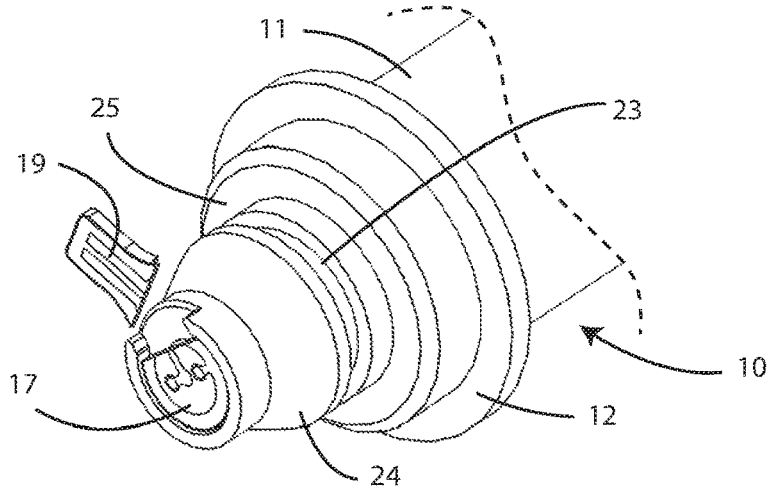
FIG. 7 shows a bottom perspective view of the lower part of the casing and of the electric igniter of FIG. 1, in a third coupling step.
Figure 8:
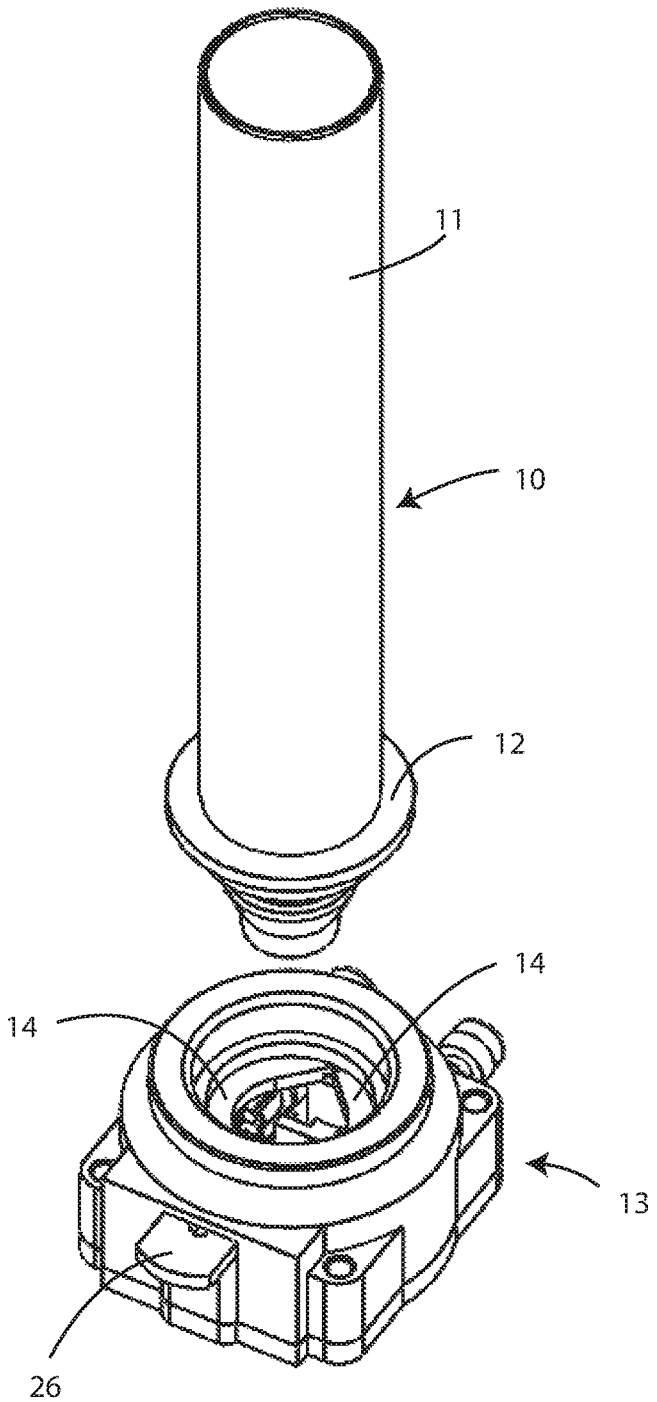
FIG. 8 shows a top perspective view of the casing and of the docking base of FIG. 1, in a step immediately preceding the coupling.
Figure 9:
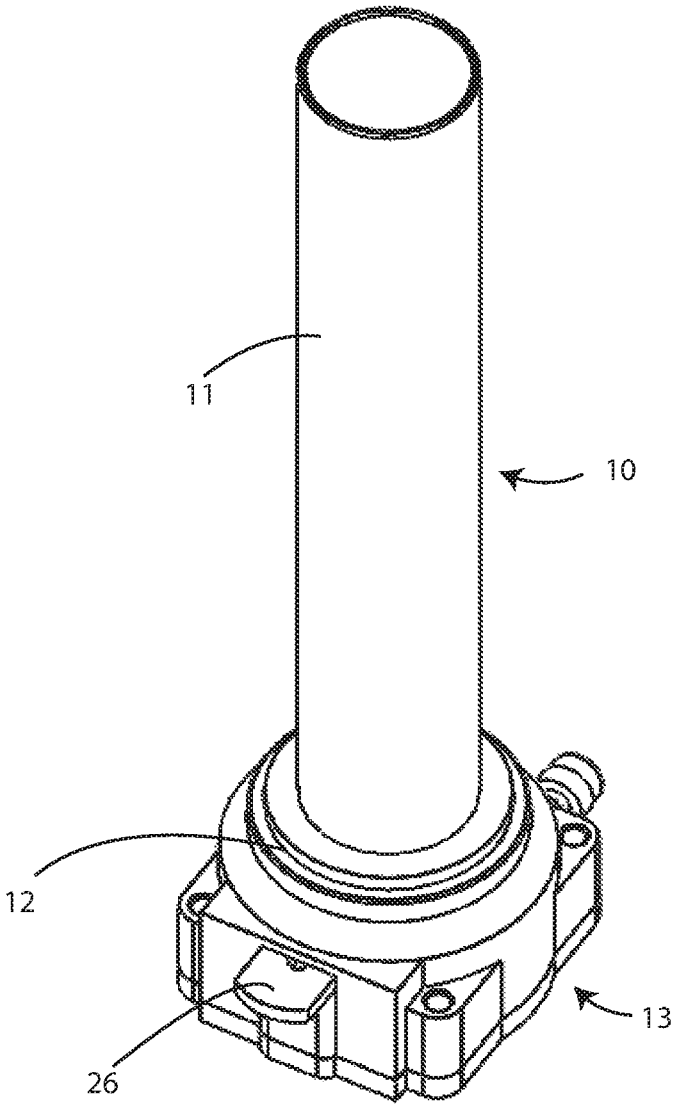
FIG. 9 shows a top perspective view of the casing and of the docking base of FIG. 1, in a coupled configuration.
Figure 10:
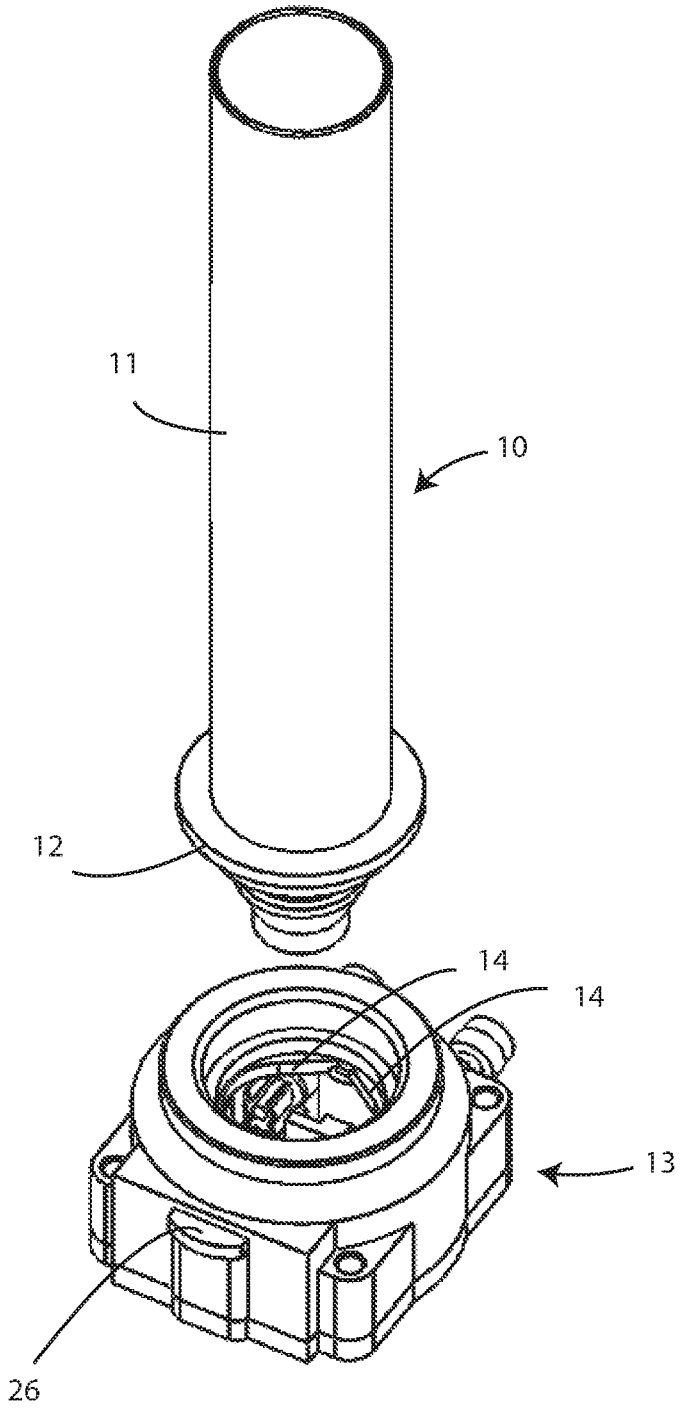
FIG. 10 shows a top perspective view of the casing and of the docking base of FIG. 1, in an uncoupled configuration.

Referring to the coupling phases shown with reference to FIGS. 5-7, after having introduced the electric igniter 16 in the axial channel 15 and having brought it until stopping in the lower end of the shaped connector 12, the short-circuiting is removed by breaking a part of the printed circuit, housed on a portion 19 of the PCB support 17, separated from the rest by a break line 22 interposed between the concentric circuit tracks and the short-circuited tracks. After breaking, the electric igniter 16 is ready for ignition.

The single-shot 10 with the electric igniter 16 is then inserted on the docking base 13 by means of a single vertical movement, without having to respect positioning constraints on the horizontal plane.

The system is designed in such a way that it is possible to safely replace a defective electric igniter 16, simply by removing the latter from the axial channel 15 of the shaped connector 12 and replacing it with a new one, without having to intervene with the disassembly or tampering of the fireshot.

The PCB 17 support with printed circuit 18 of the electric igniter 16, fitted to the shaped connector 12, offers protection from the flame front released by the launch charge, allowing the safeguarding of the mechanical and electronic components contained in the docking base 13.

The docking base 13, as already mentioned, houses inside the electronic component for the transmission of the electric signal towards the electric igniter 16.

The mechanics of the coupling is constituted by two fins 14 which, respectively, form the parts of a guillotine, able to expand and return autonomously in position by means of elastic elements; this characteristic allows to embrace, like a sort of collar, a discharge groove 23 expressly positioned on the shaped connector 12, constraining the latter to the sole rotation around its own cylindrical axis.

The shaped connector 12 has, in its lower end, before the discharge groove 23, a truncated conical portion 24, to allow the widening of the fins 14 and a better centering on the docking base 13; after the discharge groove 23, a ledge 25 ensures that the thrusts generated by the launch charge come to discharge on the structure of the docking base 13 instead of on the mechanical closing system and on the relative electronic component. This ledge 25 furthermore allows a more firm placement on the docking base 13.

The docking base 13 contains, facing upwards, three contacts 20, aligned with each other and sized in relation to the PCB support 17 of the electric igniter 16. In particular, the central contact is axially aligned with the casing 11, while the others are aligned so that contact is always guaranteed on the tracks of the contacts 20 of the docking base 13 and, therefore, the transmission of the electric impulse to the rigid igniter independently of the angular position of the break of the printed circuit 18.

When the single-shot 10, with the electric igniter 16, is hooked to the docking base 13, the contacts 20 are therefore positioned on the circuit 18 of the electric igniter 16. The continuity of the circuit 18 remains independently of the angle of the casing 11 on the horizontal axis. The casing 11, therefore, is free to rotate on its axis without circuit interruptions occurring. The contacts 20 present on the base are connected to generic connectors 21 (terminals) for electrical cables located outside the docking base 13, making the system connectable and interfaceable with any source of electrical power.

For the mechanical decoupling of the components, on the docking base 13 there is a quick-release button 26 which loosens the grip of the tabs 14 of the guillotine coupling from the discharge groove 23 of the shaped connector 12, allowing the latter to be removed.

Finally, on the body 27 of the docking base 13 there are through holes 28, to ensure the possibility of being able to place the docking base 13 wherever desired, by means of common connection or anchoring systems.

In conclusion, the system thus conceived foresees a limited number of operations that are reduced to the insertion of the electric igniter 16, the breaking of the circuit 18 and the insertion of the single-shot 10 in the docking base 13.

Moreover, the elastic coupling system, consisting of the elastic guillotine locking mechanism, keeps the trigger connected to the power source only if in the correct position. If explosions occur due to defects in the structure or failure of the support, the fireshot separates from the docking base 13, disconnecting it electrically and making it no longer dangerous.

Finally, the system would be made entirely of plastic and, once the exploded electric igniter 16 has been removed, it can be disposed of without creating special mixed waste.

The present invention has been described with particular reference to its application in the field of single-shot type fireworks, but it also applies to all those applications that require an electrical circuit, connected to a power source, in order to activate an electric igniter, by coupling two units that have terminals, which, following the coupling, coincide, creating an electrical continuity, without however imposing an initial coupling position.

The present invention has been described for illustrative but not limitative purposes, according to its preferred embodiments, but it is to be understood that variations and/or modifications may be made by those skilled in the art without departing from the relative scope of protection, as defined by the attached claims.

What is claimed is:

1. A pyrotechnic installation comprising at least one firework (10), of the single-shot type, an electric igniter (16) and a docking base (13), a removable coupling system between said firework (10) and the electric igniter (16), a removable coupling system between the firework (10) and the docking base (13) and a removable coupling and electricity transmission system between the docking base (13) and the electric igniter (16), the firework (10) including a casing (11), in which the pyrotechnic components are housed, the casing (11) having an open first side and a second side with a shaped connector (12), the shaped connector (12) comprising a channel (15) connecting to the pyrotechnic components and housing the electric igniter (16), the electric igniter (16) comprising a pyrotechnic head covered by a protective cap equipped with a sealing area (29) and provided with contacts, the sealing area (29) constituting a hydraulic seal on the walls of the channel, the contacts being rigidly coupled to a printed circuit (18) of a PCB support (17), the printed circuit (18) comprising two concentric tracks, each connected with a contact of the pyrotechnic head of the electric igniter (16) and the printed circuit (18) being short-circuited, through a connection track between the two concentric tracks, the connection track being formed on a removable portion (19) of the PCB support (17), and being configured to remove short-circuiting by removing the removable portion (19), the shaped connector (12) being removably coupled, with freedom of rotation with respect to an axis passing through the center of the concentric tracks, to a docking base (13), the docking base (13) comprising the electronic components for transmission of an electrical signal to the electric igniter (16), namely three contacts (20), aligned with each other and dimensioned in relation to the printed circuit (18) ensuring connection between the tracks of the printed circuit (18) and the contacts (20) independently of the angular position of the shaped connector (12) with respect to the docking base.

2. The pyrotechnic installation according to claim 1, wherein the removable portion (19) 0 of the PCB support (17) is connected to the rest of the PCB support (17) through a breaking line (22).

3. The pyrotechnic installation according to claim 2, wherein the printed circuit (18) PCB support (17) is stop coupled on said shaped connector (12).

4. The pyrotechnic installation according to claim 3, wherein the removable coupling system between said firework (10) and said docking base (13) comprises a shaped connector (12) of said firework (10) and a corresponding housing of said docking base (13), said housing being open upwards and provided with an elastic guillotine locking mechanism, with elastic fins (14).

5. The pyrotechnic installation according to claim 2, wherein the removable coupling system between said firework (10) and said docking base (13) comprises a shaped connector (12) of said firework (10) and a corresponding housing of said docking base (13), said housing being open upwards and provided with an elastic guillotine locking mechanism, with elastic fins (14).

6. The pyrotechnic installation according to claim 1, wherein the PCB support (17) is stop coupled on the shaped connector (12).

7. The pyrotechnic installation according to claim 6, wherein the removable coupling system between said firework (10) and said docking base (13) comprises a shaped connector (12) of said firework (10) and a corresponding housing of said docking base (13), said housing being open upwards and provided with an elastic guillotine locking mechanism, with elastic fins (14).

8. The pyrotechnic installation according to claim 1, wherein the removable coupling system between the firework (10) and the docking base (13) comprises a shaped connector (12) of the firework (10) and a corresponding housing of the docking base (13), the housing being open upwards and provided with an elastic guillotine locking mechanism, with elastic fins (14).

* * * * *